US007884692B2

(12) United States Patent
Yen et al.

(10) Patent No.: US 7,884,692 B2
(45) Date of Patent: Feb. 8, 2011

(54) TRANSFORMER STRUCTURE

(75) Inventors: Chun-Ching Yen, Taoyuan Hsien (TW); Yu-Chin Lin, Taoyuan Hsien (TW); Zhi-Liang Zhang, Taoyuan Hsien (TW); Shih-Yun Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/486,060

(22) Filed: Jun. 17, 2009

(65) Prior Publication Data

US 2010/0237972 A1 Sep. 23, 2010

(30) Foreign Application Priority Data

Mar. 18, 2009 (TW) ..... 98108821 A

(51) Int. Cl.
*H01F 27/02* (2006.01)
*H01F 27/30* (2006.01)
*H01F 27/24* (2006.01)

(52) U.S. Cl. ..... 336/90; 336/212; 336/192; 336/208

(58) Field of Classification Search ..... 336/208, 336/198.65, 90
See application file for complete search history.

(56) References Cited

U.S. PATENT DOCUMENTS

| | | | | |
|---|---|---|---|---|
| 7,446,637 | B1 * | 11/2008 | Liang et al. | 336/65 |
| 2004/0041676 | A1 * | 3/2004 | Okamoto | 336/90 |
| 2008/0204180 | A1 * | 8/2008 | Aboumrad et al. | 336/92 |

* cited by examiner

*Primary Examiner*—Anh T Mai

(57) ABSTRACT

The present invention discloses a transformer, mounted on a circuit board, including a winding set having a bobbin, a primary winding and a secondary winding, wherein the primary and the secondary windings are wound on the bobbin, and the primary winding has at least a first output terminal; a magnetic core set including a first magnetic core and a second magnetic core, wherein the winding set is sandwiched in between the first and the second magnetic cores; and an insulation base including an accommodation space and at least a pin, wherein the winding set and the magnetic core set are accommodated in the accommodation space, and the first output terminal of the primary winding is connected with the pin for further electrically connecting to the circuit board.

15 Claims, 10 Drawing Sheets

2

TRANSFORMER STRUCTURE

CLAIM OF PRIORITY

This application claims priority to Taiwanese Patent Application No. 098108821 filed on Mar. 18, 2009.

FIELD OF THE INVENTION

The present invention is related to a transformer, and more particularly to a transformer with an insulation base.

BACKGROUND OF THE INVENTION

Transformer is a common magnetic component used in electric equipments which utilizes the electromagnetic induction to regulate the output voltage to range in a suitable scope for the electric equipment.

Please refer to FIG. 1, which is a schematic view showing the structure of a conventional transformer. As shown in FIG. 1, the transformer 1 includes a bobbin 10 which is wound by a primary winding and a secondary winding (not shown), and the primary and secondary windings are wrapped in an insulation tape 12, wherein a first output terminal 131 of the primary winding is wound on a pin 101 extended from the bobbin 10, and a second output terminal 141 of the secondary winding is a flying lead having a sleeve 142 attached thereto. Further, the transformer 1 also includes a magnetic core set 11 assembled with the bobbin 10, which has wound by the primary and secondary windings. Then, the outer surface of the magnetic core set 11 is further wrapped in several layers of insulation tape 12, to conform the transformer 1 to the safety regulation. Finally, the transformer 1 is electrically connected to a circuit board (not shown) through the pin 101 and the second output terminal 141 of the secondary winding.

However, the structure of the conventional transformer has some disadvantages. First, the wrapping of the insulation tape 12 as fabricating the conventional transformer 1 will cost a lot of time, and further, the wrapping also make the transformer 1 to occupy more space and have an uncontrolled appearance, so that when the transformer 1 is mounted on the circuit board (not shown), the layout of the circuit board might be influenced. For example, the folded corner 121 of the insulation tape 12 formed along the transformer 1 might press the adjacent electronic components, or the increased volume of the transformer 1 might contact with other electronic components on the circuit board. Furthermore, since the first output terminal 131 of the primary winding on the transformer 1 has to be wound on the pin 101, it might cause a difficulty in cable management, and also, the winding of the first output terminal 131 might occupy too much space so as to have an inappropriate contact with other pins or adjacent electronic components, thereby causing a short circuit. Besides, the first output terminal 131 of each primary winding is additionally attached by a sleeve 132 for preventing an overlapping therebetween, and also for avoiding a burn damage to the insulation layer of the primary winding as welding the first output terminal 131 on the pin 101. But, the attachment of the sleeve 132 to the first output terminal 131 one by one involves complicated steps which also increase the manufacturing cost. In addition, since the second output terminal 141 of the secondary winding is a flying lead, when the transformer 1 is mounted on the circuit board (not shown), it is uneasy to position and plug the flying lead in the preset via hole on the circuit board.

Therefore, how to develop a transformer with an insulation base so as to solve the drawbacks in the prior art is really an urgent demand.

SUMMARY OF THE INVENTION

The object of the present invention is to provide a transformer which employs an insulation base to replace the conventional insulation tape used for wrapping the outer surface of the transformer, so as to save the fabrication labor and also avoid the negative influence on the transformer. Furthermore, the transformer of the present invention also utilizes at least a holding slot on a first extension portion of the insulation base to guide the first output terminal so as to facilitate the winding on the pin, and at least a through hole on a second extension portion of the insulation base to position the second output terminal of the secondary winding. Besides, the insulation base also includes at least a holding slot and at least an indentation corresponding to the bobbin, so as to simplify the assembling procedure and the manufacturing cost of the transformer, and also, improve the yield.

For achieving the object described above, the present invention provides a transformer, mounted on a circuit board, including a winding set having a bobbin, a primary winding and a secondary winding, wherein the primary and the secondary windings are wound on the bobbin, and the primary winding has at least a first output terminal; a magnetic core set including a first magnetic core and a second magnetic core, wherein the winding set is sandwiched in between the first and the second magnetic cores; and an insulation base including an accommodation space and at least a pin, wherein the winding set and the magnetic core set are accommodated in the accommodation space, and the first output terminal of the primary winding is connected with the pin for further electrically connecting to the circuit board.

Preferably, the insulation base further includes a side wall having an opening and a valley mounted thereon; a bottom plane which defines the accommodation space commonly with the side wall; a first extension portion outwardly extended from the edge of the opening and having the pin mounted thereon; and a second extension portion located at a position corresponding to the valley.

Preferably, the first extension portion of the insulation base further includes at least a notch, and the second extension further includes at least a through hole.

Preferably, the first output terminal of the primary winding in the winding set is penetrated through the opening of the side wall of the insulation base and is guided by the notch to connect with the pin, and the second output terminal of the secondary winding is in turn penetrated through the valley of the side wall of the insulation base and the through hole on the second extension portion, so as to electrically connect to the circuit board.

Preferably, the first extension portion and the bottom plane of the insulation base have a distance therebetween.

Preferably, the accommodation space of the insulation base further includes a positioning structure for positioning the magnetic core set and the winding set.

Preferably, the bobbin of the winding set further includes a main body; a tunnel penetrating through the main body; and a first block board and a second block board respectively mounted at two opposite ends of the main body, so as to define a winding region commonly with the main body for winding the primary and secondary windings.

Preferably, the first block board and the second block board of the bobbin in the winding set respectively include plural bulges, in which the bulges of the first block board are used to position the first magnetic core and the bulges of the second block board are used to position the second magnetic core.

Preferably, the first block board of the bobbin in the winding set further includes at least a holding slot, which is substantially corresponding to the first extension portion of the insulation base, and the second block board further includes at least an indentation, which is substantially corresponding to the valley on the side wall of the insulation base.

Preferably, the first magnetic core and the second magnetic core of the magnetic core set respectively include a plane, a shaft and two walls, wherein the shaft and the walls are extended from the plane, and when the magnetic core set and the winding set are assembled, the shaft is accommodated in the tunnel of the bobbin and the plane and the walls partially cover the outer surface of the winding set.

For achieving the object described above, the present invention also provides an insulation base, applied to a transformer mounted on a circuit board, wherein the transformer includes a winding set and a magnetic core set, in which the winding set includes a bobbin with a primary and a secondary windings wound thereon, and the primary winding has a first output terminal. The insulation base includes an accommodation space for accommodating the winding set and the magnetic core set; and at least a pin connected with the first output terminal of the primary winding in the winding set, so as to further electrically connect the first output terminal to the circuit board.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
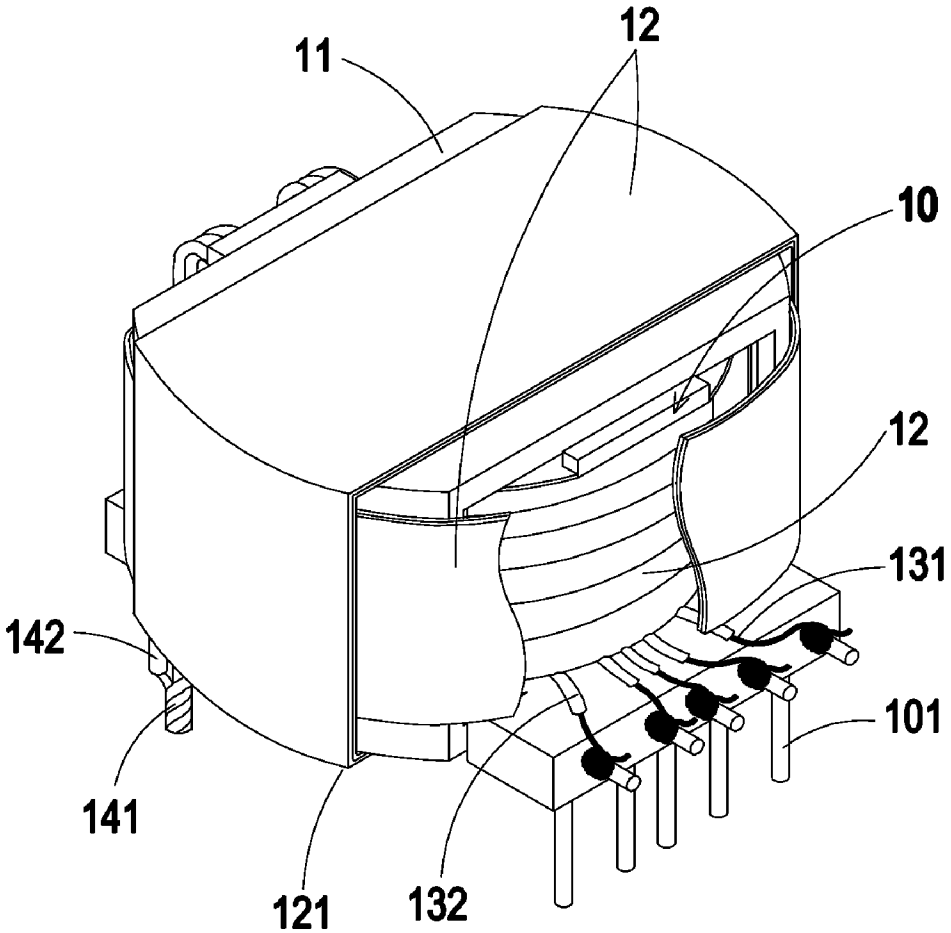
FIG. 1 PRIOR ART
FIG. 1 is a schematic view showing the structure of a conventional transformer.
Figure 2:
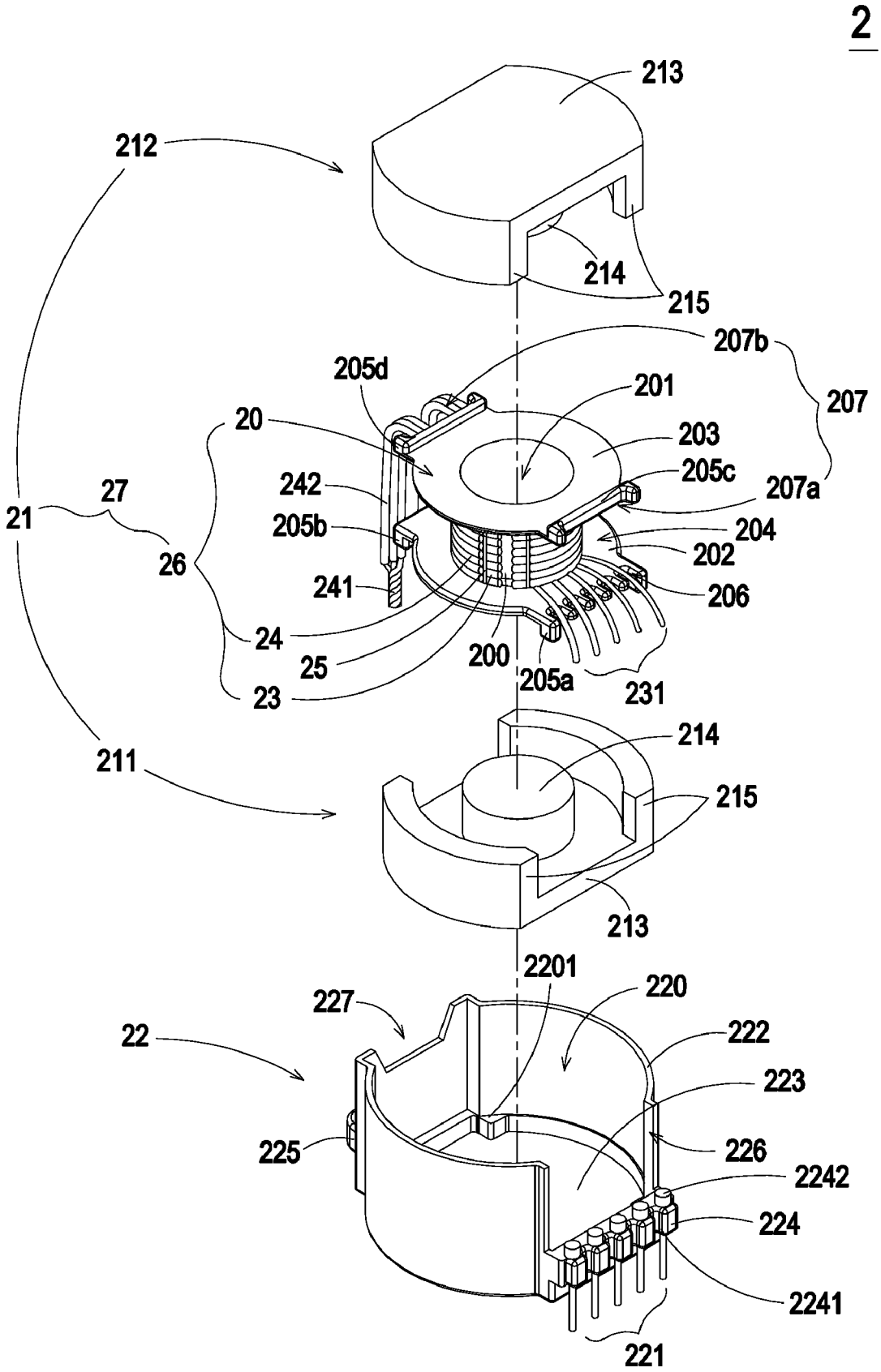
FIG. 2 is an explosion diagram showing the structure of a transformer in a first preferred embodiment according to the present invention.
Figure 4:
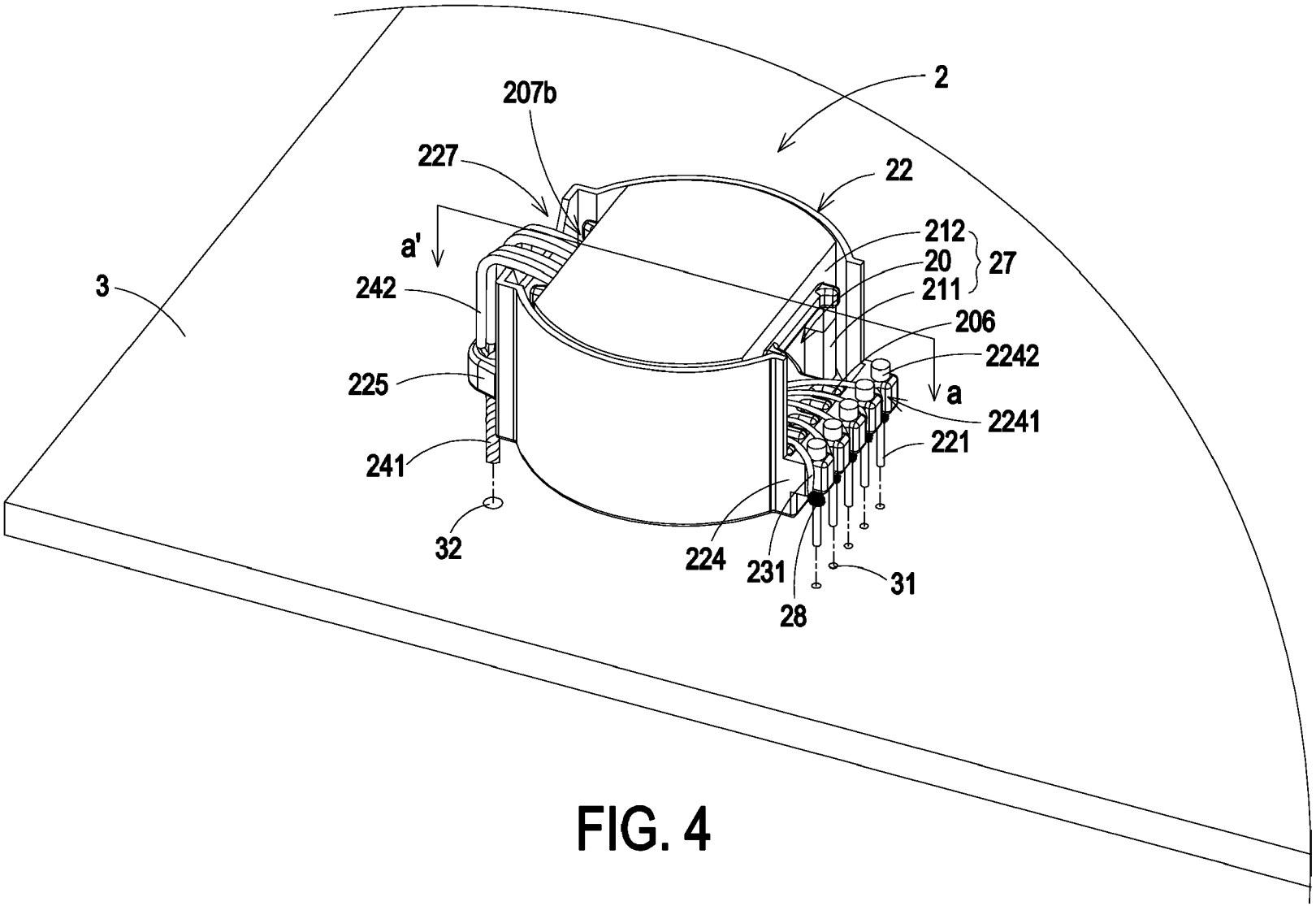
FIG. 4 is a schematic view showing the transformer of FIG. 2 which is assembled and mounted on a circuit board.

Please refer to FIG. 2, which is an explosion diagram showing the structure of a transformer in a first preferred embodiment according to the present invention. As shown in FIG. 2, the transformer 2 includes a winding set 26, a magnetic core set 21 and an insulation base 22. The winding set 26 includes a bobbin 20, a primary winding 23 and a secondary winding 24, wherein the primary and the secondary windings 23, 24 are wound on the bobbin 20, and the primary winding 23 has at least a first output terminal 231. The magnetic core set 21 includes a first magnetic core 211 and a second magnetic core 212, and the winding set 26 is located between the first and the second magnetic cores 211, 212. The insulation base 22 includes an accommodation space 220 and at least a pin 221, wherein the winding set 26 and the magnetic core set 21 are located in the accommodation space 220, and the first output terminal 231 of the primary winding 23 is connected to the pin 221 for further having an electrical connection to the circuit board 3 (as shown in FIG. 4). Followings are the detailed descriptions of the transformer structure.

As shown in FIG. 2, the winding set 26 in the transformer 2 of the present invention includes the bobbin 20 and the primary and the secondary windings 23, 24. The bobbin 20 includes a main body 200, a tunnel 201, a first block board 202 and a second block board 203. Here, the main body 200 is implemented to have a cylinder shape, and the tunnel 201 is implemented to penetrate the main body 200 along a longitudinal direction thereof, so as to form a hollow cylinder structure, and thus, part of the magnetic core set 21 can be accommodated in the tunnel 201 of the bobbin 20. The first block board 202 and the second block board 203 are respectively mounted at two opposite ends of the main body 200 and are perpendicular to the longitudinal direction of the main body 200, and further, the first and the second block boards 202, 203 have a section substantially larger than that of the main body 200, so as to define a winding region 204 among the main body 200, the first block board 202 and the second block board 203 for winding the primary winding 23 and the secondary winding 24. Here, it is preferably that the main body 200, the first block board 202 and the second block board 203 are integrally formed by a plastic material.

In this embodiment, the primary winding 23 and the secondary winding 24 wound on the winding region 204 can be conductive wires with insulated covering, such as, enameled wires, and the primary winding 23 can be separated from the secondary winding 24 by an insulation medium 25, such as, the insulation tape. Further, the primary winding 23 can include at least a first output terminal 231 and the secondary winding 24 can include at least a second output terminal 241, and the first output terminal 231 and the second output terminal 241 can be extended from the winding region 204 of the bobbin 20 respectively toward opposite directions. Here, the quantity of the first and the second output terminals 231, 241 are not limited and can be adjusted according to the purpose of the transformer 2. Moreover, for improving the insulation effect, a sleeve 242 can be further attached to the secondary winding 24 for partially covering the second output terminal 241. Besides, it should be noticed that, as the sections of the primary winding 23 and the secondary winding 24 in FIG. 2 which clearly show the relationship of the primary winding 23 and the secondary winding 24, the primary winding 23 is continuously wound on the winding region 204, and so is the secondary winding 24.

Further, as shown in FIG. 2, the first block board 202 of the bobbin 20 can be implemented to have at least a holding slot 206 mounted thereon. The holding slot 206 is located at the edge of the first block board 202 and is corresponding to the number of the first output terminal 231, so that the first output terminal 231 of the primary winding 23 which is extended toward the holding slot 204 can be retained therein. For example, in this embodiment, the primary winding 23 includes five first output terminals 231, so that the first block board 202 of the bobbin 20 is implemented to have five holding slots 206 for respectively retaining each first output terminal 231, thereby facilitating the cable management. However, it should noticed that the numbers of the first output terminal 231 and the holding slot 206 are not limited and can be varied to conform to different demands. Moreover, the second block board 203 of the bobbin 20 can be implemented to have at least an indentation 207 located at the edge of the second block board 203. In this embodiment, the second block board 203 includes two indentations 207, e.g., a first indentation 207*a* and a second indentation 207*b*. Here, the first indentation 207*a* is located at a position which is substantially symmetrical with the holding slot 206 on the first block board 206, and the second indentation 207*b* is located at a position opposite to the first indentation 207*a*, so that the second indentation 207*b* can restrict the second output terminal 241 of the secondary winding 24 which is extended in a direction opposite to the first output terminal 231. Therefore, the second output terminal 241 will not influence the assembling of the bobbin 20 and the magnetic core set 21. Here, the type and number of the indentation 207 are also not limited.

In addition, the first block board 202 of the bobbin 20 can further include a first bulge 205*a* and a second bulge 205*b*, and the second block board 202 of the bobbin 20 can further include a third bulge 205*c* and a fourth bulge 205*d*. The third and the fourth bulges 205*c*, 205*d* of the second block board 203 are respectively mounted along the first and the second indentations 207*a*, 207*b* and are protruded in an outward direction relative to the second block board 203 and also substantially parallel to the longitudinal direction of the main body 200. The first and the second bulges 205*a*, 205*b* of the first block board 202 are respectively corresponding to the third and the fourth bulges 205*c*, 205*d* of the second block board 203 and are protruded in an outward direction relative to the first block board 202 and substantially parallel to the longitudinal direction of the main body 200. In other words, the first bulge 205*a* of the first block board 202 is substantially adjacent to the holding slot 206, and by using the first to the fourth bulges 205*a*~205*d* on the first and the second block boards 202, 203, the first magnetic core 211 and the second magnetic core 212 of the magnetic core set 21 can be positioned. Here, the implementations of the first to the fourth bulges 205*a*~205*d* are not limited and can be varied as needed. For example, in this embodiment, for corresponding to the shape of the indentations 207 of the second block board 203, the third and the fourth bulges 205*c*, 205*d* are both implemented to have a Π shape, and the first and the second bulges 205*a*, 205*b* are implemented to be rectangular bulges. That is, any structure which is protruded in an outward direction relative to the first and the second block boards 202, 203 and is used to position the magnetic core set 21 can be regarded as the bulge of the first and the second block boards 202, 203.

Please further refer to FIG. 2. The magnetic core set 21 of the transformer 2 includes a first magnetic core 211 and a second magnetic core 212. In this embodiment, preferably, the first magnetic core 211 is implemented to be an E core with a plane 213, a shaft 214 and two walls 215. The width of the plane 213 is equal to or slightly smaller than the distance between the first and the second bulges 205*a*, 205*b* on the first block board 202 of the bobbin 20. The two walls 215 are upwardly extended from two opposite ends of the plane 213. The shaft 214 is also upwardly extended from the plane 213 and is located between two walls 215, and the shape of the shaft 214 is approximately matched to the tunnel 201 of the bobbin 20. Therefore, when the first magnetic core 211 is assembled with the winding set 26, the shaft 214 of the first magnetic core 211 can be accommodated in the tunnel 201 of the bobbin 20, and the plane 213 can be stacked on the first block board 202 and restricted by the first and the second bulges 205*a*, 205*b*, thereby the first magnetic core 211 can be positioned relative to the bobbin 20 of the winding set 26. And, the two walls 215 of the first magnetic core 211 can partially surround the winding set 26. Further, the second magnetic core 212 also can be an E core having a structure similar to the first magnetic core 211. The relationship between the second magnetic core 212 and the second block board 203 and the third and the fourth bulges 205*c*, 205*d* is similar to the relationship between the first magnetic core 211 and the first block board 202, so that the winding set 26 can be sandwiched in between the first and the second magnetic cores 211, 212. Of course, the first and the second magnetic cores 211, 212 also can be adhered to each other by an adhesive medium (not shown) with the winding set 26 being stably placed therebetween, so as to complete the assembling of the winding set 21 and the winding set 26.

Figure 3A:
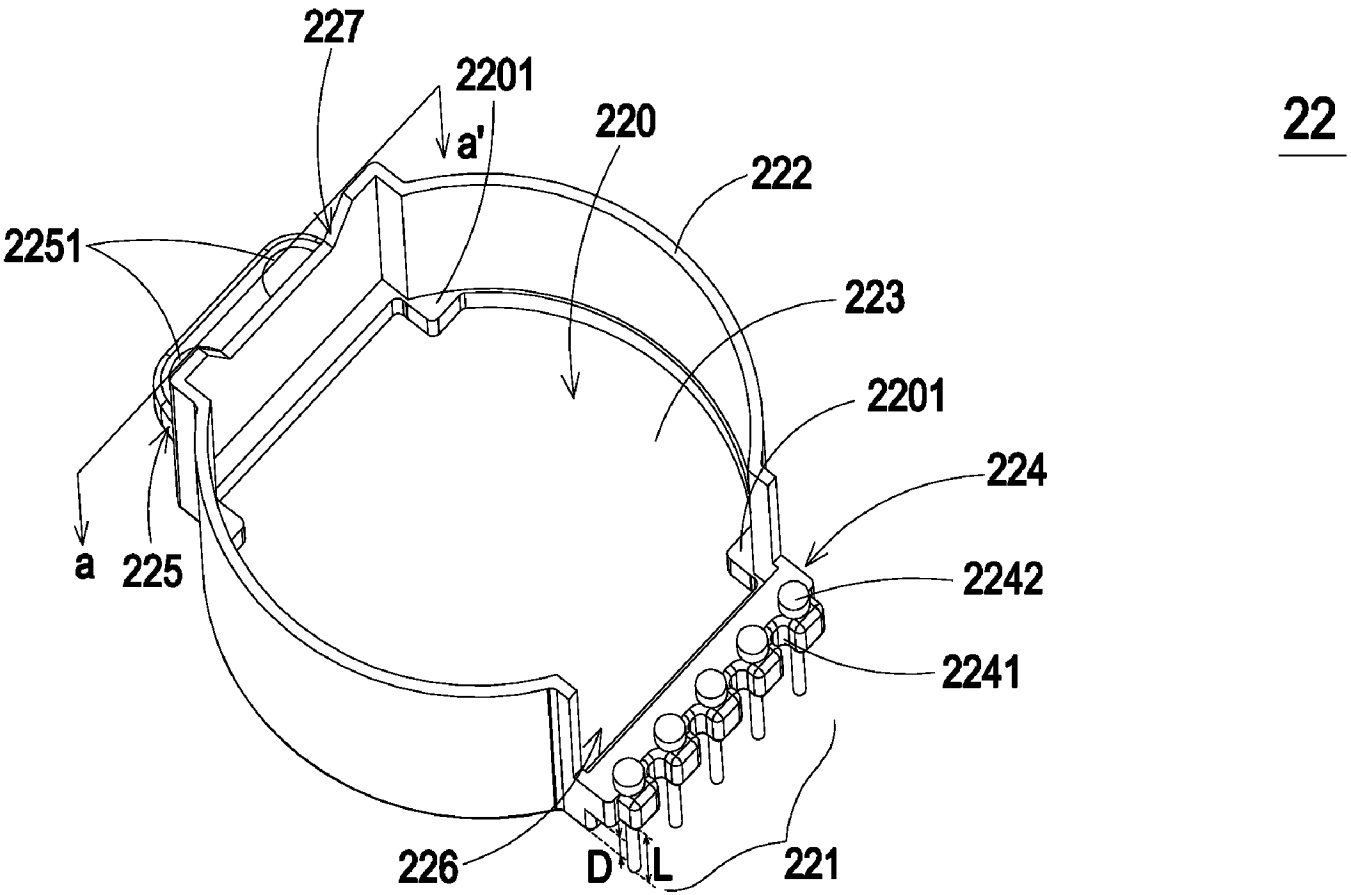
FIG. 3A is a schematic view showing the structure of an insulation base used in the transformer of FIG. 2.

Please refer to FIG. 2 and FIG. 3A, which is a schematic view showing the structure of the insulation base of the transformer in FIG. 2. In this embodiment, the transformer 2 is implemented to have an insulation base 22. The insulation base 22 includes an accommodation space 220, pins 221, a side wall 222, a bottom plane 223, a first extension portion 224, and a second extension portion 225. The side wall 222 is upwardly extended from the edge of the bottom plane 223 to have a height approximately higher than the total height of the first and the second magnetic cores 211, 212, so that the side wall 222 and the bottom plane 223 commonly define the accommodation space 220 matching to the assembled structure 27. Besides, the side wall 222 is implemented to have an opening 226 and a valley 227 mounted thereon. The opening 226 is corresponding to the first output terminal of the primary winding 23 in the winding set 26, and the valley 227 is formed at the upper edge of the side wall 222 and corresponding to the second output terminal 241 of the secondary winding 24 (as shown in FIG. 4). In this embodiment, because the first and the second output terminals 231, 241 are extended toward opposite directions, the opening 226 and the valley 227 of the insulation base 22 are substantially opposite to each other.

Figure 3B:
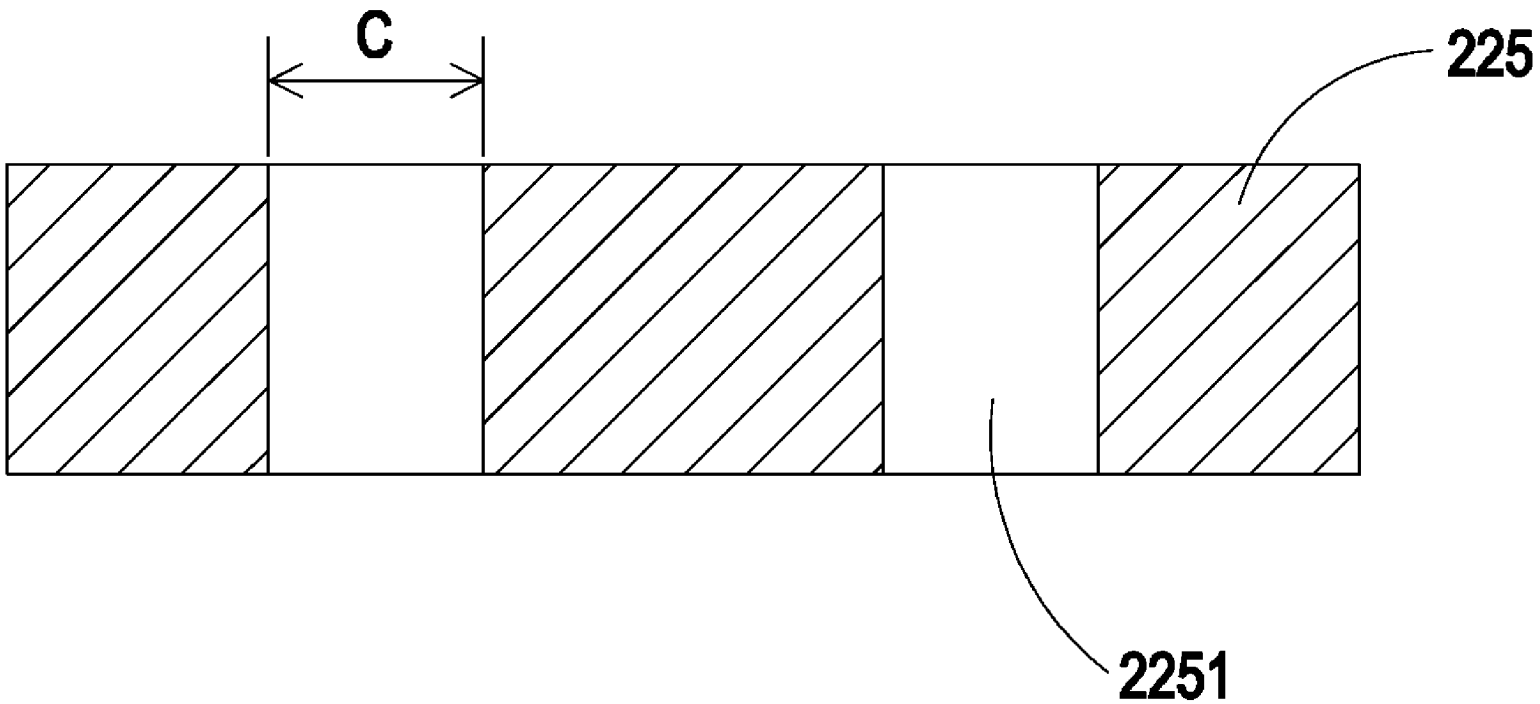
FIG. 3B is a sectional view showing the a-a' section of the insulation base in FIG. 2.

As shown, the first extension portion 224 of the insulation base 22 is mounted on the side wall 222 and is extended from an edge, such as, the lower edge, of the opening 226 in an outward direction which is parallel to the bottom plane 223, and the first extension portion 224 and the bottom plane 223 has a distance D therebetween. The pins 221 of the insulation base 22 are partially embedded in the first extension portion 224 and are extended from the first extension portion 224 in a direction toward and perpendicular to the bottom plane 223. Here, the length L of the pins 221 is substantially longer than the distance D (as shown in FIG. 3A), so that the pins 221 can be plugged in the preset plug holes 31 (as shown in FIG. 4) on the circuit board 3 through the protruded portions beyond the bottom plane 223. As to the number of the pins 221, it can be varied freely to conform to the number of the first output terminal 231 of the primary winding 23. Moreover, the first extension portion 224 further includes at least a notch 2241. The notch 2241 is substantially parallel to the pins 221 for partially accommodating the first output terminal 231 of the primary winding 23, so that the first output terminal 231 can be guided to wind on the pin 221 adjacent thereto. In this embodiment, optionally, the first extension portion 224 can further include at least a protrusion 2242 for assisting the guiding of the first output terminal 231 and also the separation between multiple first output terminals 231. As to the second extension portion 225 of the insulation base 22, it is substantially extended from the side wall 222 at a position corresponding to the valley 227, and the second extension portion 225 further has at least a through hole 2251 mounted thereon. In this embodiment, the through hole 2251 is implemented to be a circular through hole (as shown in FIG. 3B) with an aperture C, and the aperture C is substantially larger than the diameter of the second output terminal 241 of the secondary winding 24, so that the second output terminal can penetrate the through hole 2251 to electrically connect to the circuit board (as shown in FIG. 4).

As shown in FIG. 3A, the accommodation space 220 of the insulation base 22 can further include at least a positioning structure 2201. In this embodiment, the positioning structures 2201 are implemented to be positioning lumps at the corners of the bottom plane 223, so as to define a region thereamong substantially corresponding to the shape of the first magnetic core 211, thereby positioning the assembled structure 27 in the insulation base 22. Here, preferably, the side wall 222, the bottom plane 223, the first extension portion 224, the second extension portion 225 and the positioning structures 2201 are integrally formed by an insulation material, such as plastic, but not limited.

Please refer to FIG. 2 and FIG. 4, which is a schematic view showing the transformer of FIG. 2 which is assembled and mounted on a circuit board. As shown in FIG. 2, the assembled structure 27 of the magnetic core set 21 and the winding set 26 can be located in the accommodation space 220 of the insulation base 22 by facing the first magnetic core 211 to the bottom plane 223. Then, through the cooperation between the positioning structures 2201 and the first magnetic core 211, the assembled structure 27 can be positioned in the insulation base 22 without rotation. At this time, the holding slot 206 on the first block board 202 of the bobbin 20 in the winding set 26 will be substantially corresponding to and adjacent to the first extension portion 224 of the insulation base 22, so that the first output terminal 231 of the primary winding 23 which is temporarily located in the holding slot 206 can penetrate the opening 226 and be guided by the protrusion 2242 and the notch 2241 to wind on the adjacent pin 221. Then, through a welding material 28, the first output terminal 231 can be stably fixed on the pin 221 to achieve an electrical and structural connection. Moreover, the second indentation 207*b* on the second block board 203 of the bobbin 20 is substantially corresponding to the valley 227 of the insulation base 22, so that the second output terminal 241 of the secondary winding 24 which is restricted by the second indentation 207*b* can directly penetrate the valley 227 of the insulation base 22 and also the through hole 2251 of the second extension portion 225. Here, the sleeve 242 can be rejected to the second extension portion 225. Accordingly, the transformer 2 as shown in FIG. 4 is completely assembled. Of course, for preventing the separation of the assembled structure 27 and the insulation base 22, an adhesive material (not shown) also can be applied to the contact area between the plane 213 of the first magnetic core 211 and the bottom plane 223 of the insulation base 22 to ensure the structural strength of the assembled transformer.

Figure 5:
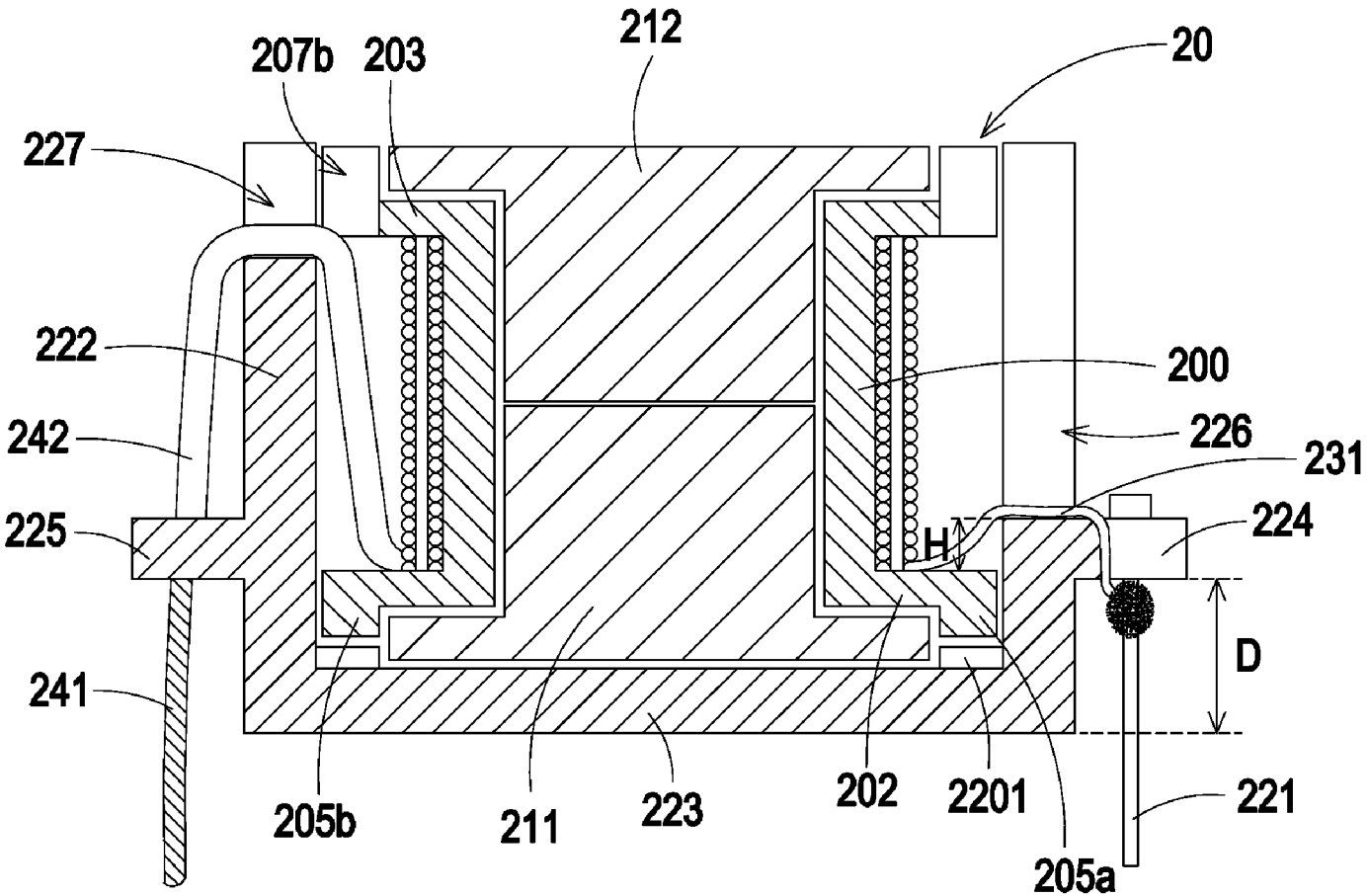
FIG. 5 is a sectional view showing the a-a' section of the transformer in FIG. 4.

Please refer to FIG. 4 and FIG. 5, which is a sectional view of line a-a' in FIG. 4. As shown in FIG. 4, the transformer 2 utilizes the insulation base 22 to replace the insulation tape 12 wound at the outer surface of the conventional transformer 1, so that the influence caused from the uncertain shape of the tape-wound transformer can be eliminated. Moreover, the first output terminal 231 of the primary winding 23 in the transformer 2 is electrically connected to the circuit board 3 by the pin 221 being plugged in the plug hole 31 on the circuit board 3. Here, since the pin 221 is extended from the first extension portion 224 of the insulation base 22, when the pin 221 is plugged in the circuit board 3, the assembled structure 27 of the magnetic core set 21 and the winding set 26 can be stably accommodated in the accommodation space 220 of the insulation base 22 without being influenced. Furthermore, the second output terminal 241 of the secondary winding 24 in the transformer 2 can be implemented as a flying lead for penetrating through the valley 227 of the insulation base 22 and the through hole 2251 of the second extension portion 225, so as to directly plug in the plug hole 32 on the circuit board 3 and thus electrically connect to the circuit board 3. Besides, because the first block board 202 of the bobbin 20 and the first extension portion 224 of the insulation base 22 have a height difference H (as shown in FIG. 5) and the first extension portion 224 is protruded in an outward direction relative to the side wall 222, the first output terminal 231 of the primary winding 23 can have a longer extension distance, so as to avoid the possible burn damage to the insulation layer when welding the first output terminal 231 on the pin 221. In addition, since the first extension portion 224 and the bottom plane 223 of the insulation base 22 have a distance D therebetween, the first output terminal 231 can be wound on the pin 221 within the distance D, so as to prevent the winding from being too close to and contacting with the circuit board 3. Further, the through hole 2251 of the second extension portion 225 can be implemented to locate at a position corresponding to the preset plug hole 32 on the circuit board 3, so that the second output terminal 241 can be precisely plugged into the preset plug hole 32 on the circuit board 3 by the guiding of the through hole 2251. And, since the sleeve 242 of the second output terminal 241 is substantially rejected to the second extension portion 225, it can ensure that the second output terminal 241 will not contact the adjacent electronic components (not shown) on the circuit board 3.

Figure 6A:
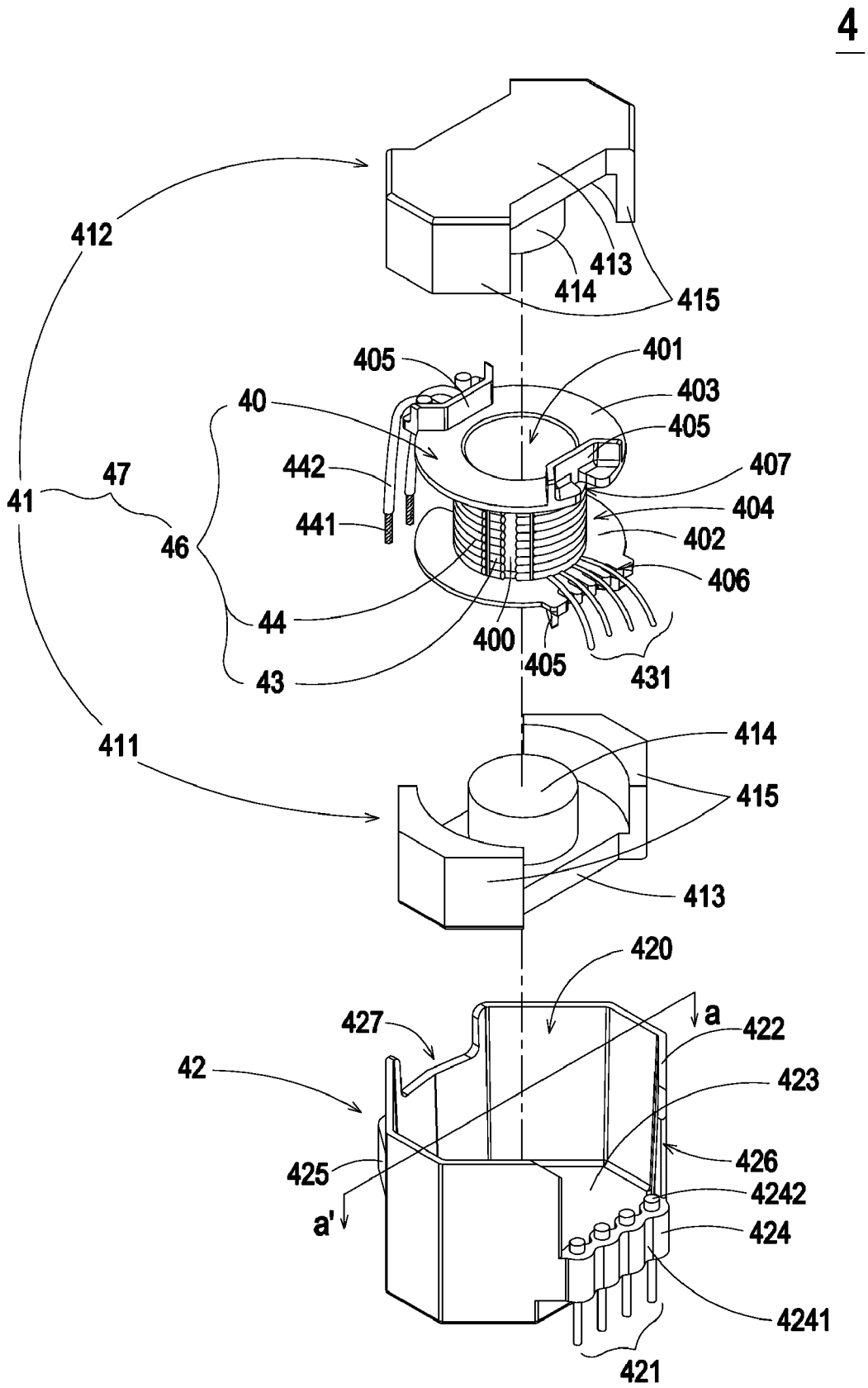
FIG. 6A is an explosion diagram showing the structure of a transformer in a second preferred embodiment according to the present invention.
Figure 6B:
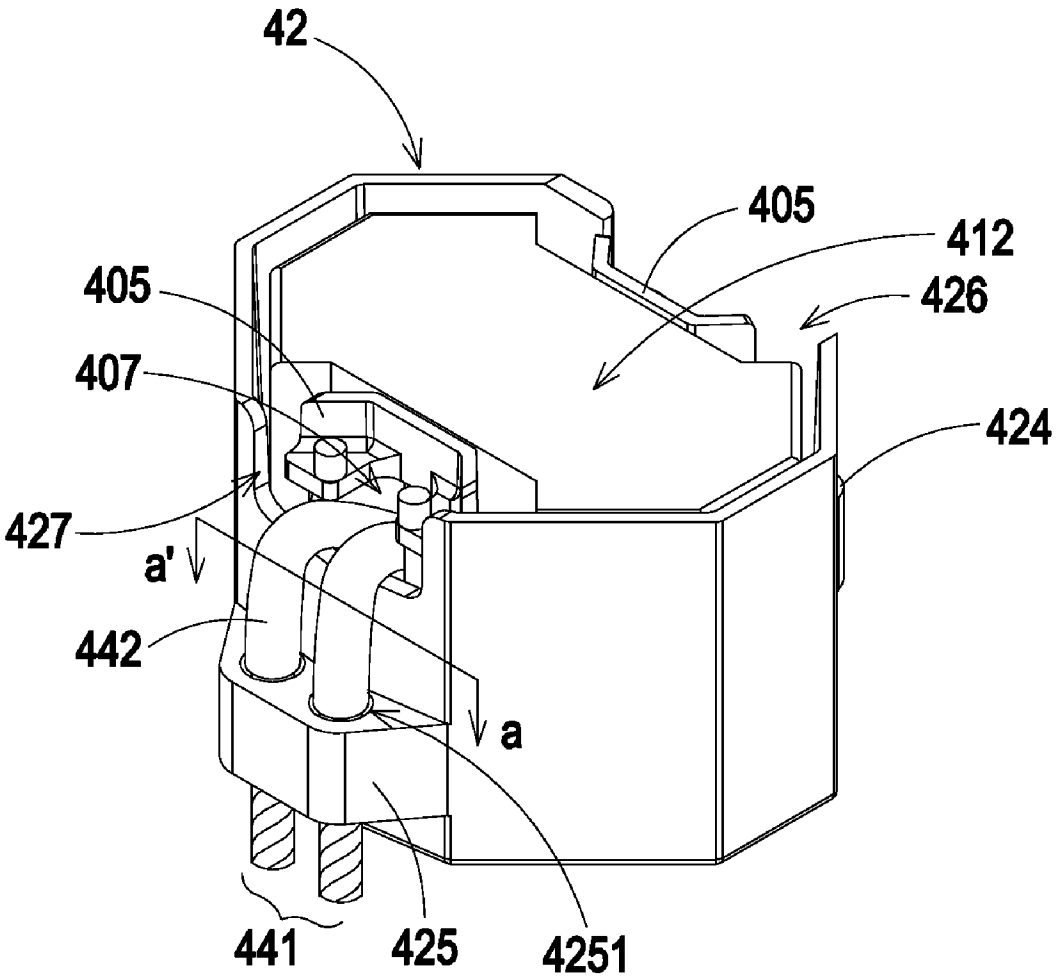
FIG. 6B is a schematic view showing the transformer of FIG. 6A after assembling.

The transformer of the present invention also can have different implementations. Please refer to FIG. 6A, which is an explosion diagram showing a transformer according to a second preferred embodiment of the present invention, and FIG. 6B, which is a schematic view showing the assembled structure of the transformer in FIG. 6A. As shown in FIG. 6A, the transformer 4 is implemented to have an octagonal structure with a winding set 46, a magnetic core set 41 and an insulation base 42. The winding set 46 includes a bobbin 40, a primary winding 43 and a secondary winding 44, and the bobbin 40 is similarly composed of a main body 400, a tunnel 401, a first block board 402 with holding slot 406, a second block board 403 with indentation 407, and a winding region 404. The construction of the winding set 46 is similar to that in the first preferred embodiment shown in FIG. 2, and thus, the description therefor is omitted. In this embodiment, the first and the second block boards 402, 403 also have plural bulges 405 for positioning the first and the second magnetic cores 411, 412. However, since the magnetic core set 41 used in the transformer 4 has a shape different from that of the magnetic core set 21 shown in FIG. 2, the bulges 405 also should be adjusted to match with the shape of the plane 413 of the first and the second magnetic cores 411, 412, so that the first and the second magnetic cores 411, 412 can be positioned in the bobbin 40 (as shown in FIG. 6B). Besides, the first and the second magnetic cores 411, 412 of the magnetic core set 41 both include a plane 413, a shaft 414 and walls 415 which are similar to the first preferred embodiment of the present invention, so that the description of the relationship thereof with the winding set 46 is also omitted.

Figure 6C:
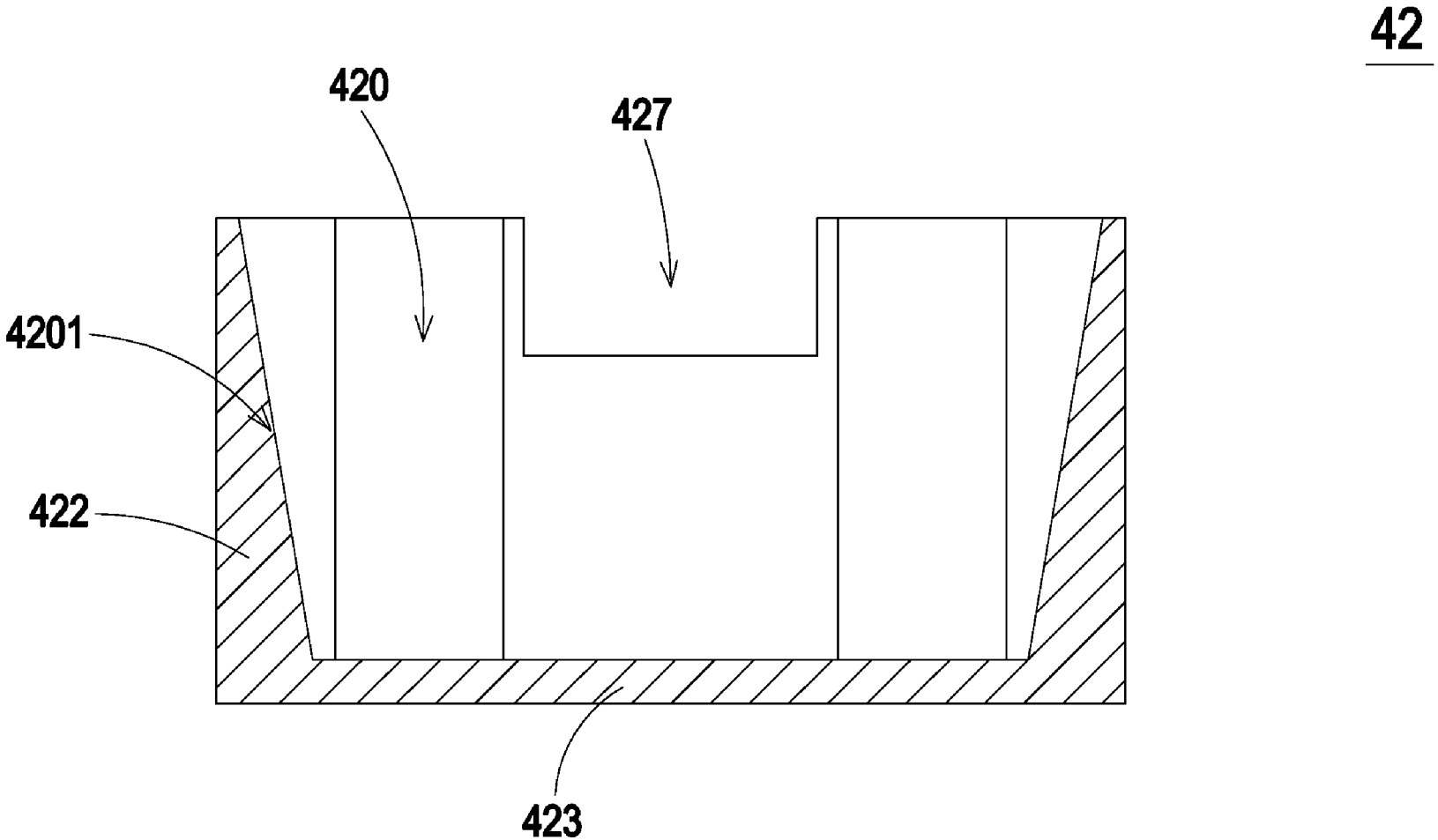
FIG. 6C is a sectional view showing the a-a' section of the insulation base of the transformer in FIG. 6A.

Please refer to FIG. 6A, the transformer 4 of the present invention is also implemented to have an insulation base 42. The insulation base 42 includes an accommodation space 420, at least a pin 421, a side wall 422, a bottom plane 423, a first extension portion 424, a second extension portion 425, an opening 426 and a valley 427 which are similar to the first preferred embodiment as shown in FIG. 2 and FIG. 3 except the shape of the insulation base 42 is altered to conform to the assembled structure 47 of the magnetic core set 41 and the winding set 46. Moreover, in this embodiment, from the top to the bottom, the thickness of the side wall 422 of the insulation base 42 is gradually getting thicker (as shown in FIG. 6C), so that the accommodation space 420 of the insulation base 42 in substance has a funnel-like shape. Therefore, when the assembled structure 47 is disposed in the accommodation space 420, through the engagement with the inner surface of the side wall 422, the assembled structure 47 can be positioned therein. That is, the inner surface of the side wall 422 can be regarded as the positioning structure 4201 in the accommodation space 420.

Figure 6D:
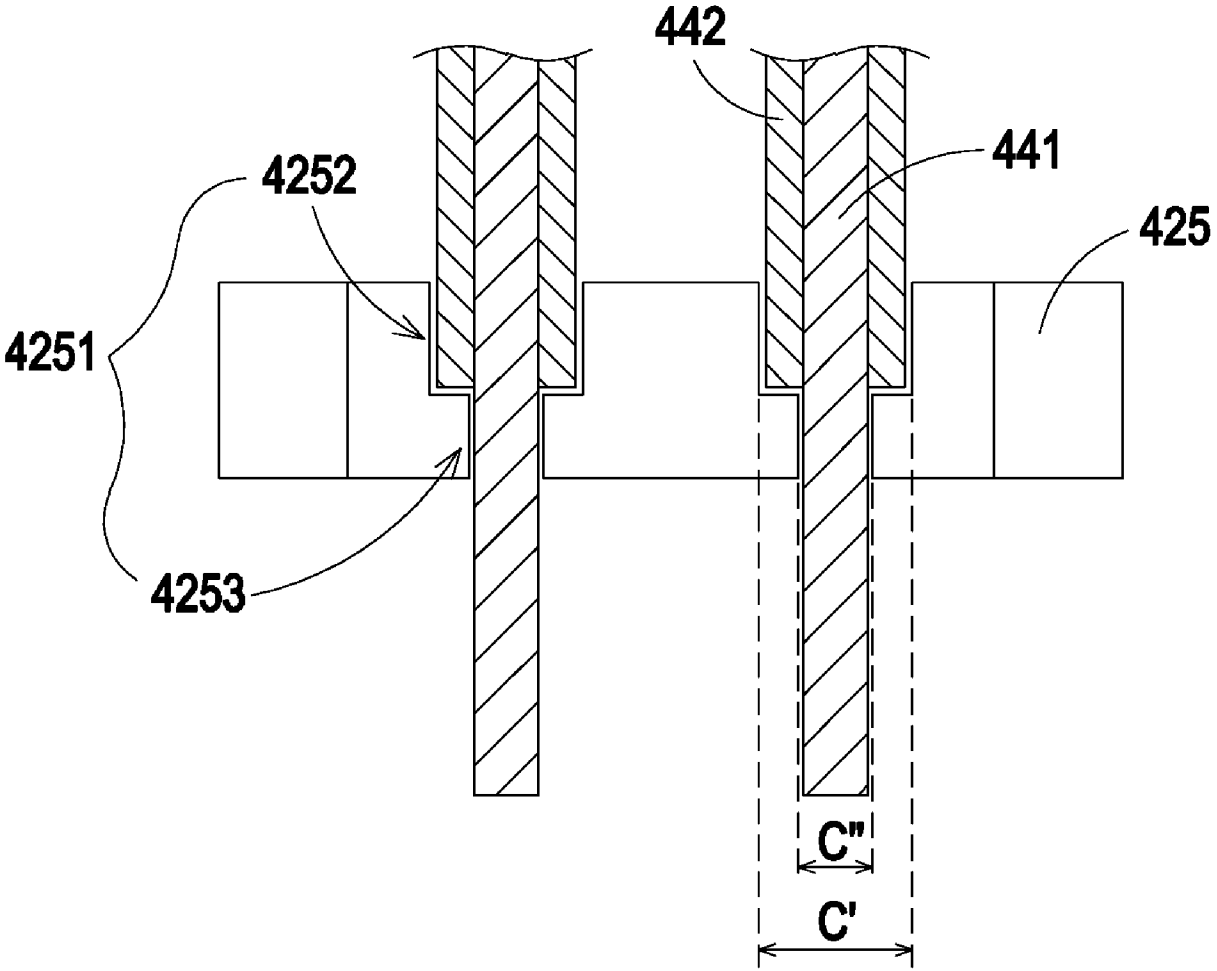
FIG. 6D is a sectional view showing the a-a' section of the transformer in FIG. 6B.

Further refer to FIG. 6A. In the transformer 4 of the present invention, the pin 421 of the insulation base 42 is also extended from the first extension portion 424, and the first extension portion 424 is also equipped with notch 4241 and protrusion 4242, so that the first output terminal 431 of the primary winding 43 can be guided to connect to the pin 421. And, the second extension portion 425 also include at least a through hole 4251 for being penetrated by the second output terminal 441 (as shown in FIG. 6B), so as to stabilize the second output terminal 441 in the insulation base 42. In this embodiment, as shown in FIG. 6D, the through hole 4251 of the second extension portion 425 of the insulation base 42 is divided into a first portion 4252 and a second portion 4253. The first portion 4252 is implemented to be a circular through hole having an aperture C', and the second portion 4253 is implemented to be a circular through hole having an aperture C". Further, the first and the second portions 4252, 4253 are implemented to be able to communicate with each other, and the aperture C" is substantially smaller than the aperture C'. Therefore, the second output terminal 441 and the sleeve 442 thereof can be respectively received in the first and the second portions 4252, 4253 of the through hole 4251. Besides, it is preferable that the aperture C" of the second portion 4253 can match with the diameter of the second output terminal 441, so that as the second output terminal 441 penetrates the second portion 4253 of the through hole 4251, the vibration thereof can be reduced, thereby facilitating the aim at the plug hole (not shown) on the circuit board.

Therefore, in accordance with the descriptions above, it is clear that the shape of the transformer according to the present invention can be varied without limitation. And, the bulges on the first and the second block boards of the bobbin in the winding set also can be designed to match with the magnetic core set, so that the magnetic core set can be engaged and positioned by the bulges. Plus, the shape of the assembled structure of the magnetic core set and the winding set also can be altered to conform to different demands, and correspondingly, at this time, it only needs to alter the shape of the insulation base for providing a corresponding accommodation space for the magnetic core set and the winding set, so that the transformer still can be insulated as being mounted on the circuit board. Besides, although in the above-described embodiments, the second output terminal is implemented to be the flying lead to directly plug into the plug hole on the circuit board, if the second extension portion of the insulation base is also implemented to have pin(s) extended therefrom, it also can be implemented to wind the second output terminal on the pin for further electrically connecting to the circuit board.

In the aforesaid, the present invention utilizes the insulation base to replace the insulation tape wound on the outer surface of the conventional transformer, which not only can provide a fixed shape for the transformer, but also can simplify the assembling procedure, so as to provide a better appearance for the transformer and also save the fabrication labor.

And, the present invention utilizes the notch on the first extension portion of the insulation base to guide the first output terminal of the primary winding to connect to the adjacent pin, so as to facilitate the cable management and also avoid the overlapping or unwanted winding between multiple first output terminals. And, the second output terminal of the secondary winding is positioned by the through hole on the second extension portion of the insulation base so as to reduce the vibration of the second output terminal as being plugged in the circuit board.

Moreover, since the first block board on the bobbin of the winding set can be implemented to have at least a holding slot mounted thereon, after the primary winding is wound on the winding region of the bobbin, the first output terminal can be temporarily retained in the holding slot for allowing the procedure of cable management; and since the second block board of the bobbin can be implemented to have at least an indentation to restrict the extending direction of the second output terminal, the assembling of the winding set and the magnetic core set will not be influenced by the second output terminal, and the assembled structure can be smoothly integrated with the insulation base. Furthermore, owing to the height difference between the first block board of the bobbin and the first extension portion of the insulation base, and the outward protruding of the first extension portion, the extending length of the first output terminal of the primary winding can be increased, so that the first output terminal of the primary winding in the present invention does not need to attach the sleeve thereto, thereby the possible burn damage to the insulation layer during welding can be avoided. In other words, as compared with the prior art, the transformer of the present invention saves the sleeve for the first output terminal, and thus, reduce the manufacturing cost and simplify the manufacturing procedure. Besides, because the first extension portion and the bottom plane of the insulation base for the transformer of the present invention have a distance therebetween, the pin within this distance can provide a separated region for winding the first output terminal so as to prevent the winding from too close to the circuit board. As to the second output terminal of the secondary winding, it can be rejected to the second extension portion of the insulation by the sleeve attached thereto, so as to ensure the insulation effect. Consequently, the transformer according to the present invention, as compared with the prior art, can improve the yield, simplify the manufacturing procedure and reduce the fabrication cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, mounted on a circuit board, comprising:
a winding set, including a bobbin, a primary winding and a secondary winding, wherein the primary and the secondary windings are wound on the bobbin, and the primary winding has at least a first output terminal;

a magnetic core set, including a first magnetic core and a second magnetic core, wherein the winding set is sandwiched in between the first and the second magnetic cores; and an insulation base, including an accommodation space, at least a pin, a side wall, a bottom plane, a first extension portion and a second extension portion, the side wall having an opening and a valley mounted thereon, the bottom plane defining the accommodation space with the side wall, the first extension portion outwardly extended from the edge of the opening and having the pin mounted thereon, and the second extension portion located at a position corresponding to the valley, wherein the winding set and the magnetic core set are accommodated in the accommodation space, and the first output terminal of the primary winding is connected with the pin for further electrically connecting to the circuit board.

2. The transformer as claimed in claim 1, wherein the first extension portion of the insulation base further includes at least a notch, and the second extension portion further includes at least a through hole.

3. The transformer as claimed in claim 2, wherein the first output terminal of the primary winding in the winding set is penetrated through the opening of the side wall of the insulation base and is guided by the notch to connect with the pin, and a second output terminal of the secondary winding is in turn penetrated through the valley of the side wall of the insulation base and the through hole on the second extension portion, so as to electrically connect to the circuit board.

4. The transformer as claimed in claim 1, wherein the first extension portion and the bottom plane of the insulation base have a distance therebetween.

5. The transformer as claimed in claim 1, wherein the accommodation space of the insulation base further includes a positioning structure for positioning the magnetic core set and the winding set.

6. The transformer as claimed in claim 1, wherein the bobbin of the winding set further comprises:

a main body;

a tunnel, penetrating through the main body; and a first block board and a second block board, respectively mounted at two opposite ends of the main body, so as to define a winding region commonly with the main body for winding the primary and secondary windings.

7. The transformer as claimed in claim 6, wherein the first block board and the second block board of the bobbin in the winding set respectively include plural bulges, in which the plural bulges of the first block board are used to position the first magnetic core and the plural bulges of the second block board are used to position the second magnetic core.

8. The transformer as claimed in claim 6, wherein the first block board of the bobbin in the winding set further includes at least a holding slot, which is substantially corresponding to the first extension portion of the insulation base.

9. The transformer as claimed in claim 6, wherein the second block board of the bobbin in the winding set further includes at least an indentation, which is substantially corresponding to the valley on the side wall of the insulation base.

10. The transformer as claimed in claim 6, wherein the first magnetic core and the second magnetic core of the magnetic core set respectively include a plane, a shaft and two walls, wherein the shaft and the walls are extended from the plane, and when the magnetic core set and the winding set are assembled, the shaft is accommodated in the tunnel of the bobbin and the plane and the walls partially cover the outer surface of the winding set.

11. An insulation base, applied to a transformer mounted on a circuit board, wherein the transformer comprises a winding set and a magnetic core set, in which the winding set includes a bobbin with a primary and a secondary windings wound thereon, and the primary winding has a first output terminal, the insulation base comprising:

an accommodation space, for accommodating the winding set and the magnetic core set;

at least a pin, connected with the first output terminal of the primary winding in the winding set, so as to further electrically connect the first output terminal to the circuit board;

a side wall, having an opening and a valley mounted thereon;

a bottom plane, defining the accommodation space with the side wall;

a first extension portion, extended from the edge of the opening and having the pin mounted thereon; and a second extension portion, located at a position corresponding to the valley.

12. The insulation base as claimed in claim 11, wherein the first extension portion further includes at least a notch for guiding the first output terminal of the primary winding in the winding set to connect with the pin.

13. The insulation base as claimed in claim 11, wherein the second extension portion further includes at least a through hole, and a second output terminal of the secondary winding penetrates the through hole for further having an electrical connection to the circuit board.

14. The insulation base as claimed in claim 11, wherein the accommodation space of the insulation base further includes a positioning structure for positioning the magnetic core set and the winding set.

15. The insulation base as claimed in claim 11, wherein the first extension portion and the bottom plane have a distance therebetween.

* * * * *